US005131519A

United States Patent [19]

Ra

[11] Patent Number: 5,131,519

[45] Date of Patent: Jul. 21, 1992

[54] VENDING MACHINE COIN BOX LOCKING MECHANISM

[76] Inventor: Corky Ra, 1502 River La., Santa Anna, Calif. 92706

[21] Appl. No.: 775,577

[22] Filed: Oct. 15, 1991

[51] Int. Cl.[5] ..... G07F 9/06

[52] U.S. Cl. ..... 194/350; 232/15

[58] Field of Search ..... 194/236, 237, 255, 292, 194/350; 232/15, 16; 222/370; 221/155, 265

[56] References Cited

U.S. PATENT DOCUMENTS

| | | | |
|---|---|---|---|
| 753,824 | 3/1904 | Caldwell et al. | 221/155 |
| 929,568 | 7/1909 | Davis | 194/292 |
| 1,050,608 | 1/1913 | Brown | 194/353 X |
| 1,316,492 | 9/1919 | Mason | 194/255 |
| 1,627,547 | 5/1927 | Antoine et al. | 221/152 |
| 2,759,632 | 8/1956 | Ussery et al. | 221/155 X |
| 2,853,172 | 9/1958 | Angel | 221/5 X |
| 3,390,753 | 7/1968 | Bolen et al. | 194/350 |
| 3,783,986 | 1/1974 | Bolen | 194/350 |
| 3,804,294 | 4/1974 | Householder | 221/265 X |
| 4,544,081 | 10/1985 | Voegeli | 221/155 |

*Primary Examiner*—F. J. Bartuska
*Attorney, Agent, or Firm*—M. Reid Russell

[57] ABSTRACT

A coin box locking mechanism for original installation or retrofitting in a conventional coin operated vending machine where, with the depositing of an appropriate coin in a coin mechanism and turning of that coin mechanism handle, a measured volume of product, such as loose candy, nuts, or the like, will vend from a chute in a front face of which vending machine onto a person's hand. The coin box locking mechanism includes a base retainer that is for installation onto the top surface of the vending machine base, and receives a plurality of spaced brackets, each secured at one end of each to the base retainer, the brackets extending upwardly within the vending machine body, with the opposite bracket ends supporting a flat horseshoe shaped shelf thereon. The horseshoe shaped shelf has parallel legs extending from ends of a web, the opposite ends of each of which legs are bent back upon themselves forming seats, each seat for receiving an edge of a flat cover fitted therein. The cover is formed for fitting across the top of the vending machine body and includes a key operated lock mounted therein such that an operator, turning a key turns a lock spindle that pivots a bar end beneath the web of which flat shelf, thereby locking that cover in covering engagement over the coin containing portion of the vending machine body.

4 Claims, 2 Drawing Sheets

VENDING MACHINE COIN BOX LOCKING MECHANISM

BACKGROUND OF THE INVENTION

1. Field of the Invention

This invention relates to coin operated vending machines, particularly, to vending machines where by turning a handle loose product, gum balls, or the like, are dispensed and to locking mechanism for securing coin containing bodies of such vending machines.

2. Prior Art

Coin operated vending machines that are handle or crank operated by inserting an appropriate coin into a slot and turning the handle clockwise to receive a loose product such as nuts or candy, gum balls, or the like, out of a chute are well known. Such machines are found in many locations as are trafficked by the general public. The design of such coin vending machines has essentially remained the same over a number of years except as to changes in materials as are used to construct the machine, with many machines now being constructed mostly of plastic. Additional to changes in material, other earlier changes and improvements have been made to vending machine coin receiving and turning mechanisms from an early patent to Brown, U.S. Pat. No. 1,050,608 to a more recent patent to Bolen, U.S. Pat. No. 3,783,986. Also, arrangements for setting and controlling the volume of product dispensed with each handle turn, are shown, for example, in the patent to Brown U.S. Pat. No. 1,050,608 and in patents to Antoine, U.S. Pat. No. 1,627,547, to Angell, U.S. Pat. No. 2,853,172, and in a recent patent to Voegeli, U.S. Pat. No. 4,544,081. None of which patents have involved a locking mechanism for controlling access to a coin containing vending machine body like that of the present invention.

The present invention is useful for new manufacture and as an addition inclusion to a number of the currently marketed designs of coin operated vending machines for securing the coin box area against unauthorized entry. The present invention provides an internal mounting and locking plate for closing off which coin receiving body, securing the contained coins against theft when the machine is refilled with product. In which refilling process an operator may replace with an empty body the coin filled vending machine body for later opening by a key controlled by a manager or owner. With the installation of the present invention, access to the coin containing area of a vending machine body is key controlled.

SUMMARY OF THE INVENTION

It is a principal object of the present invention to provide a coin box locking mechanism new manufacture or retrofilling to a conventional coin operated vending machine for providing a key controlled access to a coin containing body thereof.

Another object of the present invention is to provide a coin box locking mechanism suitable for installing into most currently available coin operated vending machines.

Another object of the present invention is to provide, for mounting a shelf across a top area of the vending machine body whereto a cover can be releasably maintained utilizing a key operated pivot arm lock mechanism.

Still another object of the present invention is to provide a coin box locking mechanism that allows which vending machine product display head end to be easily and conveniently separated for filling or replacement.

Still another object of the present invention is to provide a coin box locking mechanism that is easily and conveniently installed within a body of a conventional coin operated vending machine.

The coin box locking mechanism of the present invention is for initial manufacture or retrofitting across a coin box area of a body of a conventional coin operated vending machine. Which machine dispenses, on turning of a handle of a coin mechanism, a measured amount of loose product that falls out of a chute. The coin box locking mechanism includes at least a pair, but preferably two pairs, of brackets that are straight bars with inturned opposing parallel ends. One end of each of which brackets is for securing to a base plate secured within the vending machine body, with the opposite inturned bracket end for supporting and coupling to a U-shaped shelf. The shelf is positioned above the vending machine coin mechanism and includes tabs formed by inturning the ends of which shelf legs back over themselves. The tabs are each for receiving an edge of a coin box lock cover that is fitted thereunder, the cover resting on the coin box lock shelf. Which coin box lock cover includes a coin box lock fitted therein that is key operated so as to turn a lock bar under and out from under the coin box lock shelf web, providing for locking which coin box lock cover onto coin box lock shelf.

In practice, a person servicing a vending machine that incorporates the present invention can remove and fill the head or product containing portion of the vending machine and replace the coin filled vending machine body with an empty body. Which coin filled body can then be opened by a key allowing the cover to be removed and the coins emptied therefrom. A person refilling machines with product will not have access to the coin filled body that is later opened by a person entrusted with the key.

DESCRIPTION OF THE DRAWINGS

In the drawings that illustrate that which is presently regarded as the best mode for carrying out the invention.

DETAILED DESCRIPTION

Figure 1:
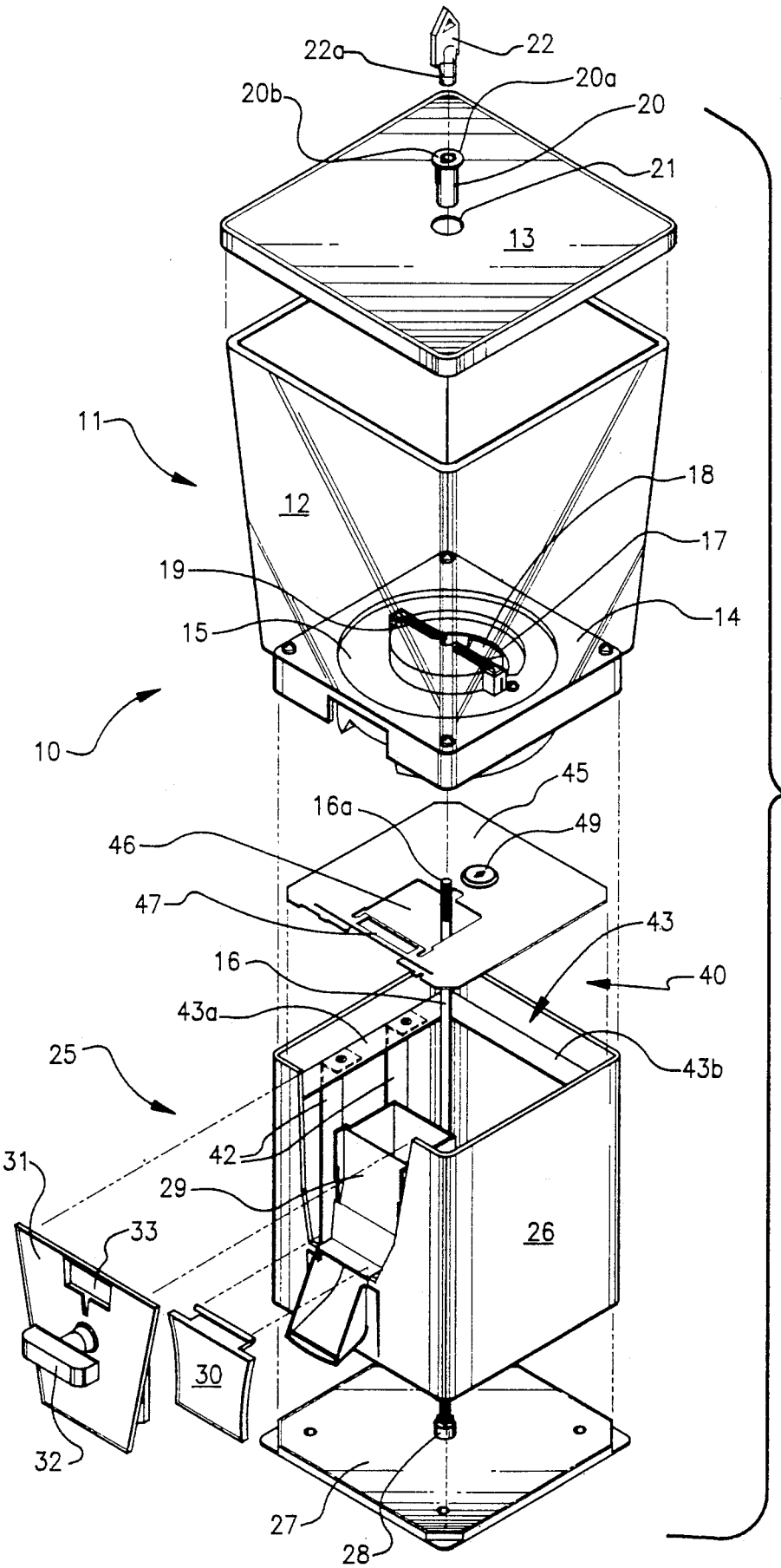
FIG. 1 is an exploded perspective view of a coin operated vending machine that includes the coin box locking mechanism of the present invention.

FIG. 1 shows an exploded perspective view of a coin operated vending machine 10, hereinafter referred to as vending machine. The vending machine 10 is conveniently separated into a hopper or head portion 11, that is filled with bulk product and body 25. Such bulk product, may consist of loose nuts or candy, or the like, and is displayed through a transparent globe 12 that is maintained between a cap 13 and hopper bottom 14. The hopper bottom contains a brush wheel 15 that is journaled to turn as a carrousel around a center rod 16. The brush wheel incorporates a center dispensing wheel 17 wherein are radially arranged, as arcuate depressions, a number of cups 18. The brush wheel 15 is turned by operation of a coin operated vending mechanism, as described herein below, and turns also the dispensing wheel 17 around the center rod 16. Dispensing wheel turning positions a product filled cup 18 over an end of chute 29, the product falling through which chute and is vended into a person's palm held below the chute bottom end. Means are preferably provided within the cup 18 for setting a desired volume therein and a curtain 19, shown as consisting a side-by-side row of springs, is provided above the path of turning of which dispensing wheel 17, for brushing off excess product as piles above which cup 18 top lip.

The above set out description of the vending machine hopper or head portion 11 should be taken as describing a hopper or head portion of a currently marketed vending machine that is manufactured by Oak Manufacturing Co. Inc. known as a Vista Machine. Neither this hopper or head portion, nor the body 25, as set out and described below, of this Vista Machine are new and unique and are described herein only by way of example of a vending machine that is suitable for receiving the vending machine locking mechanism of the present invention.

The body 25 of the Vista Machine, as shown in FIG. 1, includes a square cylindrical housing 26 wherethrough the center rod 16 is erected, extending at a right or normal angle axially from a collar 28 that is fixed to the center of a base 27. The center rod 16 is for joining the body 25 and hopper or head portion 11 together, forming the vending machine 10. To provide this coupling, the center rod 16 is threaded at its end 16*a* for receiving a threaded locking sleeve 20 turned thereon that is fitted through the cup 13. The locking sleeve has a flanged top end 20*a* whose edge extends beyond the edge of a center hole 21 formed through the cap 13. With the hopper or head portion 11 fitted onto the body 25 the threaded end 16*a* of center rod 16 will extend to just below the undersurface of the cap 13 to receive the end of the locking sleeve 20 turned thereon. Which turning is accomplished by fitting a key 22 into a keyway groove 20*b* that is formed around the center of and into the surface of the locking sleeve flanged top end 20*a*. Which keyway groove 20*b* is opposite to a top of a spindle that is journaled in which locking sleeve. The spindle top is serrated around its outer edge to fit into a like grooved portion that is formed around the inner edge of a cylindrical base 22*a* of the key 22. Which key cylindrical base edge further includes an outwardly projecting pin that is for fitting in a notch formed in the keyway groove 20*b*, the key tab to fit into which notch and seat in that keyway groove. By turning key 22 the locking sleeve spindle is turned onto the threaded end 16*a* of center rod 16. So arranged, the key 22 when fitted into the locking sleeve 20 and turning the spindle journaled therein provides for a quick mounting and dismounting of the hopper or head 11 onto the body 25. Which arrangement is standard to the industry and is found on many coin operated vending machines, in addition to the Vista Machine.

Figure 2:
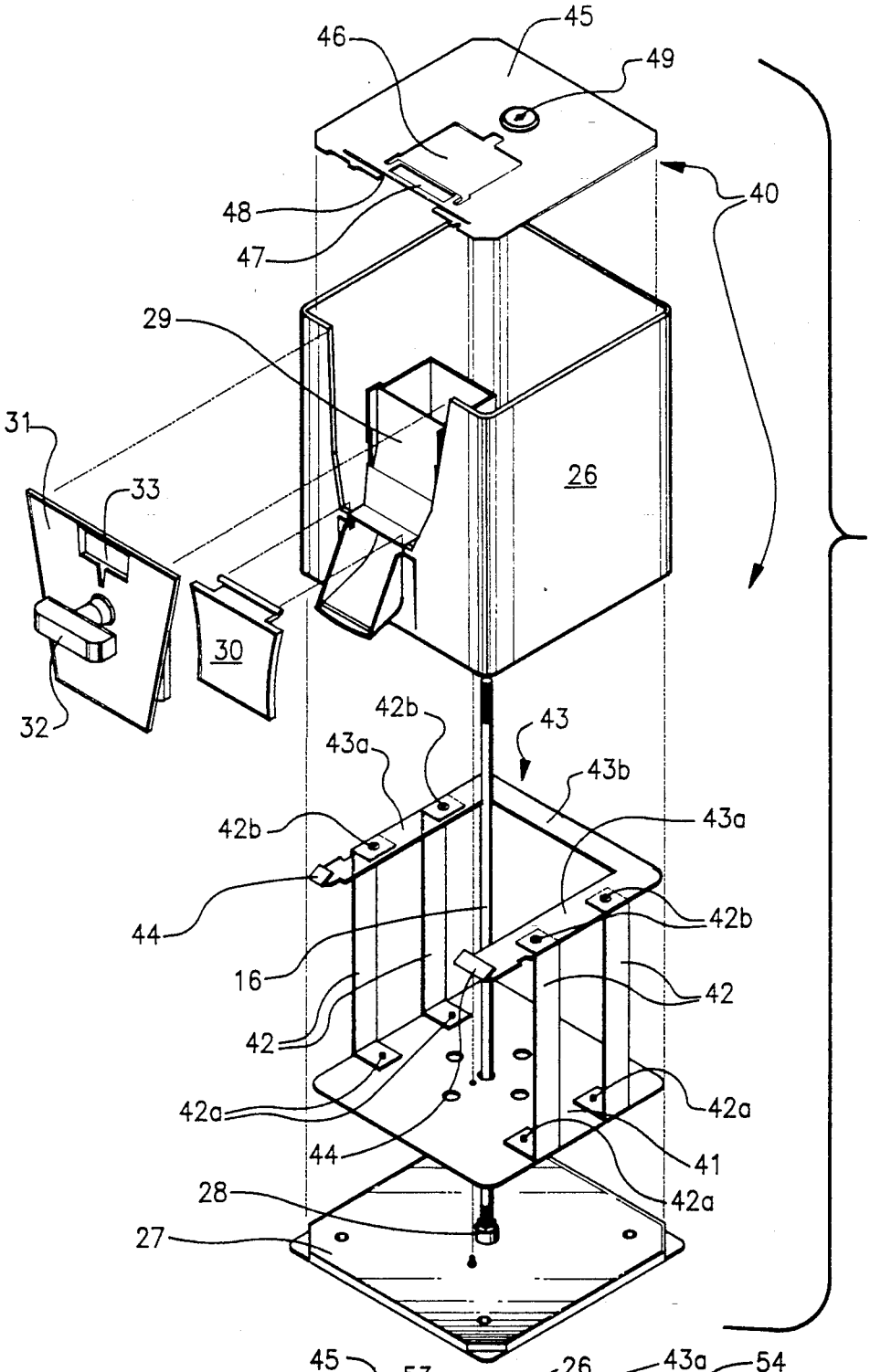
FIG. 2 is an exploded perspective view of the body of the coin box vending machine of FIG. 1, showing the coin box locking mechanism exploded therefrom.

Shown best in FIG. 2, the body 25 includes the square cylindrical housing 26 arranged for fitting onto the base 27 with the center rod 16 extending at a right or normal angle upwardly from the base 27 collar 28. The housing 26 is slotted in one wall from a top edge to above the bottom thereof for accommodating, at the slot bottom, a dispensing chute 29, that includes a pivoting cover 30 that is pivotally mounted across the chute dispensing end to swing upwardly from a covering attitude over that dispensing chute end. A coin mechanism 31 is slide into the housing slot above the chute, the coin mechanism edges interdigitating with the slot edges, with a bottom edge of which coin mechanism to engage the top of the chute cover, covering the chute cover pivot mounting seats.

The coin mechanism 31 has been in common usage in the industry for many years and includes a handle 32 arranged below a coin receiving slot 33. To operate which coin mechanism, a coin is deposited into the receiving slot 33 and the handle 32 is turned. In which handle turning, the coin presence trips the mechanism, allowing the handle to turn with the coin expelled from the mechanism and falls into the body housing 26. The handle turning pivots an arm, not shown, that engages to rotate the dispensing wheel 17 through a partial rotation. The partial rotation of which dispensing wheel moves an empty cup 18 off the chute end and aligns a product filled cup 18 over that dispensing chute end 29. The product in which filled cup 18 thereby falls through the chute 29 against the pivoting cover 30 that is lifted by a patron receiving the vend.

The above described coin operated vending machine, is known as a Vista Machine, and is suitable for retrofitting to receive a coin box locking mechanism 40 of the present invention. Shown best in FIG. 2, the coin box locking mechanism 40, hereinafter referred to as locking mechanism is contained within the housing 26 and includes a base retainer 41 that is secured as with screws, nuts and bolts, or like fasteners across the top of base 27 to the edges of which base retainer 41 are secured, as with rivets, screws, or like fasteners, lower ends or tabs 42*a* of at least a pair of equally spaced brackets 42. The opposite or upper ends or tabs 42*b* of each of which brackets 42 are inturned in the same direction as lower ends or tabs 42*a*. Upper bracket ends or tabs 42*b* are secured, also as by rivets, screws or like fasteners, to support a shelf 43 thereon. The shelf 43 is a flat thin U-shaped plate that is open across its center area with parallel legs 43*a* that are connected at their ends to a web 43*b*, with the opposite leg 43*a* ends folded back upon themselves into seats 44. The pair of seats 44 thus formed are to receive the edge of a cover 45 fitted therein, for prohibiting lifting of that cover edge. The cover 45 is preferably a flat thin plate that is shaped to fit into the housing 26, proximate to a top thereof and is supported on the shelf 43. The cover includes a square hole 46 formed therethrough that conforms to the end of chute 29 for passing product and proximate to the cover edge that fits into seats 44 and includes a slot 47 formed adjacent to an edge of square hole 46, with a notch 48 formed in which cover edge. The slot 47 is for accommodating the arm that extends from the coin mechanism 31 that, on turning of handle 32, moves along the slot 47 for turning the dispensing wheel 17 to vend product from a cup 18 that falls through the chute 29. The notch 48 at the edge of which cover provides for a close fitting engagement with the interior surface of coin receiving slot 3 of the coin mechanism 31.

Figure 3:
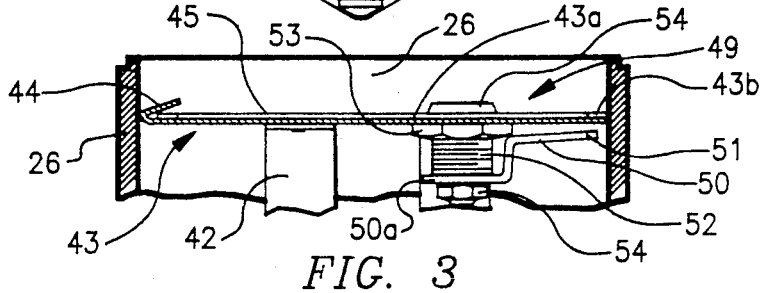
FIG. 3 is an expanded side elevation sectional view of the assembled coin box lock cover and lock of the coin box locking mechanism of FIG. 2.

As set out above, the cover 45 is maintained at seats 44 against lifting along its edge wherein notch 48 is formed. Further, a key operated lock 49, hereinafter referred to as lock, as shown best in FIG. 3, is included to prohibit the cover from lifting off at the shelf web 43*b*. The key operated lock 49 is mounted in the cover to turn a bar 50 so as to move the bar end 51 beneath the shelf web 43*b*. The lock 49 is preferably a standard desk type lock and is fitted into a hole formed through the cover 45. Lock 49 consists of a threaded barrel 52, whereover a nut 53 is turned to engage the undersurface of cover 45, sandwiching the edge between it and the undersurface of a key end 54 of the lock 49. Which threaded barrel contains a spindle journaled therein that is for turning with a key. The opposite end of which spindle is shown as having been fitted through an end 50*a* of bar 50 and receives a nut 55 turned thereover for coupling which bar end to which spindle end. The bar 50, as shown, is bent through two right angles such that the bar end 51 is parallel and spaced apart from the bar base end 50*a* to be adjacent to the undersurface of the shelf web 43*b*. So arranged, a key is fitted into to turn the lock spindle that turns the connected bar 50 so as to move the bar end 51 beneath that shelf web. The cover is thereby prevented by its edge mounting in seats 44 and the bar end positioned under the shelf web from lifting off of the shelf 43 until the lock bar end 51 is turned out of locking engagement.

Shown best in FIG. 2, the locking mechanism 40 cover 45 closes over the top of housing 26, retaining, in that housing 26, coins as have been ejected from the coin mechanism 31 on turning the handle 32 through a full revolution. Which cover 45 positioning, as shown, is preferably across of top end of which housing. Though, within the scope of this disclosure, the brackets 42 length, shelf 43 and cover 45 configurations can be such that the cover is seated well within and across the interior of housing 26 as long as coins falling from the coin mechanism 3 are thereby contained within the housing 26 below cover 45.

As set out above, the vending machine 10 head or hopper portion 11 is easily separated from the body 25, allowing for filling that head or hopper portion with product and replacement onto the body 25. In practice, with the locking mechanism 40 installed, an operator can remove a coin filled body 25 for later opening by a key operator, and replace that body with an empty body. So arranged, access to the coin containing body 25 is provided only to persons with a key to the locking mechanism 40, minimizing a potential for unauthorized coin removal.

While a preferred arrangement of a vending machine coin box locking mechanism of the present invention has been shown and described herein, it should be understood that the present disclosure is made by way of example only, and that changes and modifications can be made thereto without departing from the subject matter coming within the scope of the following claims and a reasonable equivalency thereof, which claims I regard as my invention.

I claim:

1. A coin box locking mechanism for a coin operated vending machine comprising, a base retainer consisting of a plate for securing onto a coin operated vending machine base that mounts across the bottom end of a body of the coin operated vending machine, and means for securing said base retainer onto a top surface of said vending machine base; a plurality of bracket means each for spaced mounting at their bottom ends onto said base retainer, extending within said vending machine body for supporting, on their opposite ends, a horseshoe shaped shelf; a flat horseshoe shaped shelf that has equal parallel legs that extend, in the same direction, from the ends of a web, the ends of which said legs are bent back upon themselves forming seat means that are to receive the edge of a cover fitted for preventing that cover edge from lifting therefrom; a cover formed as a flat plate to fit within the vending machine body that is holed and slotted appropriately to accommodate a dispensing chute and coin mechanism of said vending machine; and a key operated lock means for mounting in said cover that includes a pivoting bar that is turned by a key into and out of alignment with the undersurface of said shelf.

2. A coin box locking mechanism as recited in claim 1, wherein the bracket means are two pairs of brackets each having ends that are inturned into parallel tabs, a lower tab of each bracket for mounting onto the base retainer, with the upper tab of each bracket for supporting the flat shelf thereon; and fastener means for securing said bracket tabs to said base retainer and flat shelf, respectively.

3. A coin box locking mechanism as recited in claim 2, wherein the brackets are of a length to where the cover resting on the flat shelf will align essentially with the top of the vending machine body.

4. A coin box locking mechanism as recites 1, wherein the key operated lock means is secured in an opening in the cover adjacent to the cover edge that is supported of the flat shelf web, the pivoting bar to turn under said flat shelf web.

* * * * *